United States Patent [19]

Inoue

[11] 4,086,450

[45] Apr. 25, 1978

[54] VARIABLE THICKNESS CONE FOR A DYNAMIC SPEAKER AND QUALITY CONTROL INSPECTION METHOD THEREFOR

[76] Inventor: Kenzo Inoue, 22, Kitatanda, Yofu-cho, Tokai-shi, Aichi-ken, Japan

[21] Appl. No.: 740,292

[22] Filed: Nov. 9, 1976

[30] Foreign Application Priority Data

Jun. 25, 1976 Japan ..... 51-075894

[51] Int. Cl.[2] ..... H04R 7/12

[52] U.S. Cl. ..... 179/181 R; 181/174

[58] Field of Search ..... 179/181 R, 181 F; 181/173, 174

[56] References Cited

U.S. PATENT DOCUMENTS

| | | | |
|---|---|---|---|
| 1,832,832 | 11/1931 | Nagelvoort | 181/174 |
| 2,297,218 | 9/1942 | Henrich et al. | 179/181 F |
| 3,862,376 | 1/1975 | White | 179/115 R |
| 3,983,337 | 9/1976 | Babb | 179/115.5 R |

FOREIGN PATENT DOCUMENTS

| | | | |
|---|---|---|---|
| 1,092,061 | 11/1960 | Germany | 179/181 R |
| 2,450,262 | 4/1976 | Germany | 181/174 |

*Primary Examiner*—George G. Stellar
*Attorney, Agent, or Firm*—Browdy and Neimark

[57] ABSTRACT

A dynamic speaker including a cone, which is of relatively thin rigid truncated cone shape, having a number of radial ribs extending from the central opening portion toward the peripheral portion thereof, and being progressively diminishing, in respect of the stiffness at the concentrical sections, from the central opening portion toward the peripheral portion thereof, with the object of getting excellent sound effects, a high output power and other merits. Methods of manufacturing the dynamic speaker are also included in this invention.

3 Claims, 10 Drawing Figures

FIG. 1 CONVENTIONAL
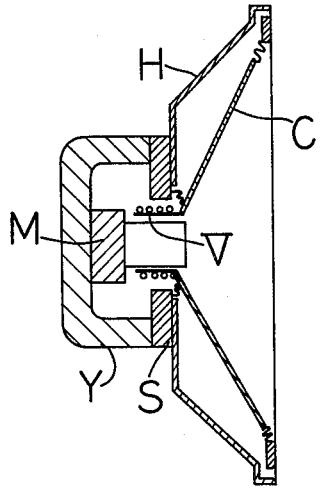

FIG. 3 CONVENTIONAL
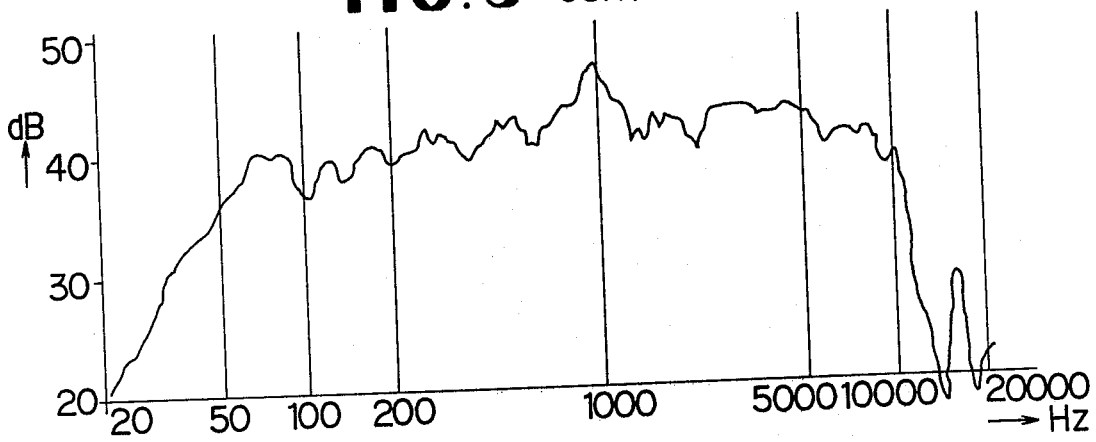
FIG. 8
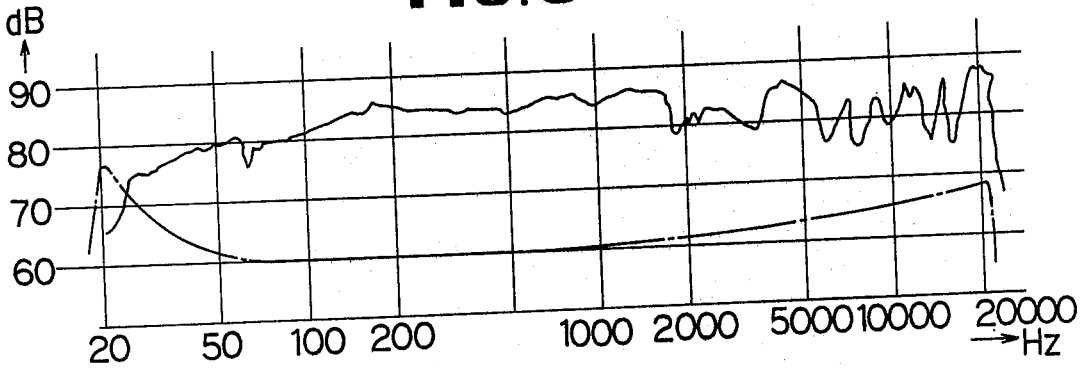
FIG. 9 (a)
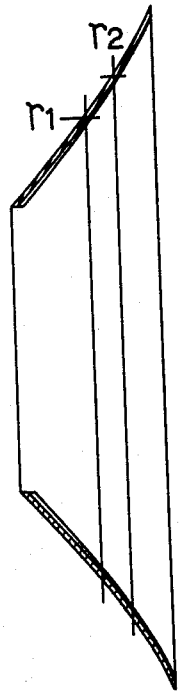
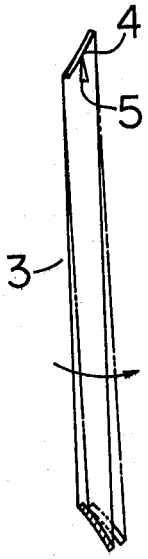
FIG. 9 (b)

VARIABLE THICKNESS CONE FOR A DYNAMIC SPEAKER AND QUALITY CONTROL INSPECTION METHOD THEREFOR

BACKGROUND OF THE INVENTION

A dynamic speaker is generally constructed, as shown in FIG. 1, with a yoke Y attached to a permanent magnet M producing a powerful, radial magnetic field, a center retainer S concentrically holding a movable coil (voice coil) V in the air gap or central opening thereof, and a cone housing H attached to the opposite side of the yoke Y for movably supporting a vibrating plate (a cone) C therein, with the smaller diameter portion being secured to the voice coil and the larger diameter portion being movably connected to the divergent opening of the housing H.

In the conventional speakers the cone tends to be relatively thin for reducing the entire mass and to be relatively large in size for producing a larger output, which inevitably brings about some undesirable defects such as: (a) thinness of the cone makes the same inferior in stiffness or rigidity and incapable of effectively using the entire surface thereof; (b) bending or flexion of the cone makes the input wave-form difficult to be transmitted intact to the output; (c) inside loss is relatively large, which is an unavoidable disadvantage caused by the light-weight and low-stiffness of the cone; and (d) a combination of three speakers for high, medium and low sound areas is employed for keeping constant sound characteristics regardless of the frequencies, which combination however being too delicate and unsuitable for mass production of the cones.

This invention is aimed at the provision of dynamic speakers excellent in frequency characteristics ranging over a wide sound area, and highly efficient in reproducing real sound wave-form regardless of the relatively small size of the cone, by giving the same an appropriate stiffness with some novel structural techniques.

SUMMARY OF THE INVENTION

The present invention relates to a speaker called a dynamic type speaker which includes a movable coil. More particularly it relates to the provision of a single type speaker excellent in frequency characteristics over a broad area ranging from high, medium to low sound areas.

It is an object of this invention to provide a fundamentally novel speaker, based on an idea entirely different from the prior art, eliminating the shortcomings accompanying to the conventional ones, by raising the stiffness of the speaker cone so as to minimize the bending or flexion, between the vibration causing portion (central portion) and the portion away therefrom (peripheral portion), of the cone.

It is another object of this invention to provide a novel speaker giving a relatively large output for the size of the cone (external diameter).

It is yet another object of this invention to provide a novel speaker superior in the real reproductivity of the input wave-form regardless of its relatively light-weight and single type structure.

It is still another object of this invention to provide novel methods of manufacturing the dynamic speakers.

BRIEF DESCRIPTION OF THE DRAWINGS

FIG. 1 is a vertical sectional view of a conventional type speaker;

FIG. 3 is a graph showing the frequency characteristics curve of the conventional type speaker;

FIG. 8 is a graph of characteristic curve of a dynamic speaker including a cone shown in FIG. 4, wherein the phantom line is an impedance curve;

FIG. 9(*a*) is a sectional view of a cone including the axis thereof; and

FIG. 9(*b*) is a sectional view of a cut-away annular member of the cone showing the suspension condition thereof.

DETAILED DESCRIPTION OF THE INVENTION

Figure 2:
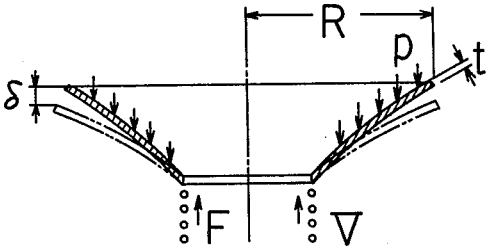
FIG. 2 is a vertical sectional view of a cone for explaining the flexion or deflection thereof.

For better understanding of the present invention general principles of the conventional type speakers, fundamental conditions required to the speaker of superior performance and some problems therearound should be referred to before entering the detailed description of preferred embodiments of this invention. In the well-known formula $F = Bli$, wherein $B$ is a flux density in the air gap in which a voice coil is mounted, $l$ is the entire length of the coil, and $i$ is the electric current through the coil, $F$ represents the force moving the voice coil V in the axial direction thereof. Since B and l are generally constant, F is directly proportionate to i and has no connection with the frequency thereby seems to have no affection on frequency characteristics. When the voice coil V moves the cone C, however, in the axial direction by its vibration causing force F, a positive air resistance, which is considered a uniformly diffused or distributed load, acts on the front side of the cone, and a negative air resistance similarly acts on the rear side of the cone, whereby this vibrational movement forms compression waves in the air. Assuming that a cone is imparted a vibration causing force at the central opening portion thereof by a voice coil to be vibrated while receiving the above-mentioned air resistance, a circular member, to be more exact an annular plate member, or a cone, which is sustained at the vibration-causing portion thereof around the periphery of the central opening, as shown in FIG. 2 is subjected to a deformation just like when it receives a uniformly distributed load. Although the deformation incessantly varies, it is reasonable to think that the cone should be in the state shown in FIG. 2 at each given instant. As the outer periphery of the cone may be either perfectly free or flexibly supported so as to be allowed to axially move, it is reasonable to assume that the cone be in a nearly medium state between the solid and phantom lines in FIG. 2.

Two fundamental conditions required for a good speaker are: (1) the input wave-form can be transmitted really intact as the output wave-form (vibration); and (2) a sound can maintain its constant characteristics (Hz-dB curve is to be flat regardless of frequencies.

For satisfying the above-mentioned requirements the cone tends to be thinner and larger in area or size as well as smaller in mass to exclude inertia effect or influence. In the thin and far less-stiff conventional cones, however, the relatively larger area thereof is not entirely utilized satisfactorily, and it is even doubtful whether the vibration causing portion and the peripheral portion are vibrating at a same frequency. Little consideration seems to be paid to the influence of the flexion in the cone.

A deflection $\delta$ of a neutral plane (a neutral layer of a cone with the thickness $t$) in a circular plate having the thickness $t$, in case of free periphery, is represented in the following formula:

$$\delta = K \cdot \frac{P \cdot R^4}{E \cdot t^3}$$

Wherein

K is a coefficient of a constant value;

P is axial component of air pressure (resistance);

R is external radius;

E is Young's modulus; and $t$ is thickness.

The deflection $\delta$ is, in a static condition, proportional to the fourth power of the radius R, and is inversely proportional to the third power of the thickness $t$. The amplitude at the peripheral portion is to be lessened, when dynamically observed, by as much as the deflection influence than that at the central portion, or vibration causing portion.

In conventional cones, particularly for Hi-Fi use, thin paper or cloth is used for minimizing the mass, therefore neglecting the alleviation of deflection (increasing the denominator $E \cdot t^3$ in the above formula). Lessening $t$ and E to the greatest possible extent leads to enlarging the $\delta$ value, which is apt to impair the consistency of the vibration frequencies at the central and peripheral portions of the cone.

The earlier stated method of combining three speakers of different stages, used for example in stereophonic phonographs, is too delicate to be applied to mass production, in addition to being defective in often increase of inside loss. These are inevitable drawbacks accompanying to the Hi-Fi speakers which are of relatively large size, light weight, and low stiffness.

Figure 4:
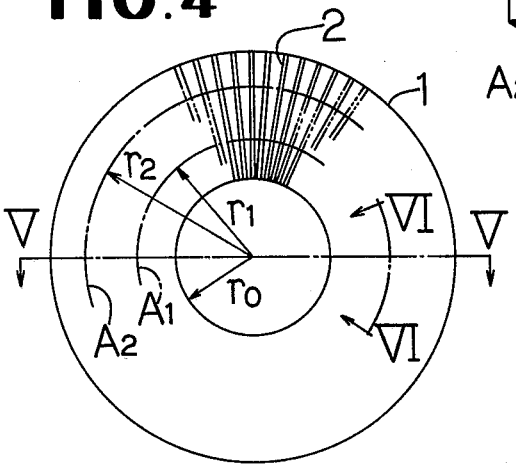
FIG. 4 is an elevational view of a cone in accordance with an embodiment of this invention.
Figure 5:
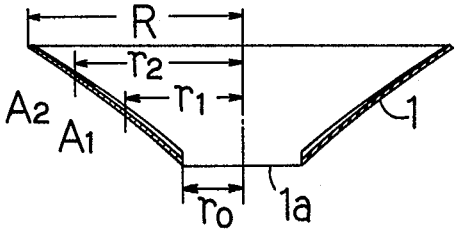
FIG. 5 is a sectional view taken along the line V — V of FIG. 4.
Figure 6:
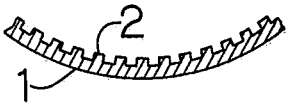
FIG. 6 is an enlarged fractional sectional view taken along the line VI — VI of FIG. 4.
Figure 7:
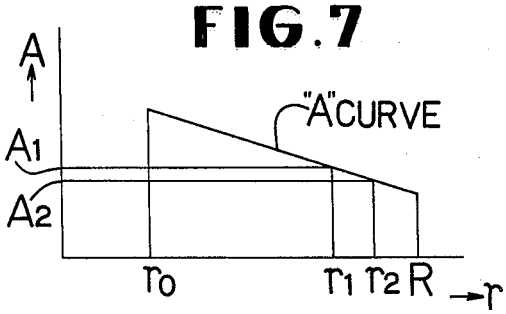
FIG. 7 is a curve graph showing the variation of the sectional area cut by the concentrical cylinders with each of radii in FIG. 4 or FIG. 5 against each corresponding radius.

Referring to FIGS. 4 to 6, a preferable embodiment of this invention, a novel speaker cone, eliminating the defects of the conventional ones, which has been enhanced in the stiffness ranging from the central portion toward the peripheral portion, will be described hereinafter.

A cone 1 of morning-glory-flower shape, being slightly warped inwards i.e., convex to the front, is the greatest in the wall thickness around the central opening (or throat) portion 1a and is progressively diminished in thickness toward the peripheral portion. It is provided integrally with a number of relatively closely arranged radial ribs 2. It is formed of, by means of injection molding, a material composed of a thermoplastic resin, superior in strength and stiffness, containing glass fiber of 20 to 30%, of even more therein.

Assume that the cone 1 is cut with several concentrical cylinders having any given radius $r_1$, $r_2$ — from the axis of the cone, wherein each radius is larger than the radius $r_0$ of the central opening portion and smaller than the radius R of the peripheral portion, and that each sectional area cut is represented by $A_1$, $A_2$ — (rib 2 is included in this sectional area). The cone in accordance with this invention is formed as an annular plate supported at the central opening portion, so it is necessarily required that any section at a position with smaller radius is greater in the stiffness than any section at a position with greater radius. The stiffness of a section is theoretically not directly connected with the size of the sectional area thereof, as it varies with the arrangement of ribs and so on. Increasing the stiffness of a cone, however, almost always means increasing of the sectional area, because it is next to impossible to provide ribs of intricate configuration onto a thin plate member like a cone.

Making the sectional area of the concentrical section at a nearer position to the central opening portion greater than that at a farther position thereto necessarily leads to making the stiffness of the former section greater. In other words, the only condition that should be satisfied is:

if $r_1 < r_2$ then $A_1 > A_2$ this condition is hereinafter referred to as "sectional condition". If a curve of sectional areas plotted on a graph (hereinafter simply referred to as A curve), wherein the radius is set on abscissa and the sectional area is set on ordinate, progressively declines (not necessarily in a straight line) the abovementioned "sectional condition" is satisfied. This is the very requisite condition needed for obtaining lightweight but rigid speakers of good frequency characteristics over a wide range, that is the basis of this invention.

As a criterion for judging or inspecting the performance of a speaker cone the "A" curve based on actual measurements is practically utilized. If the "A" curve described upon measuring the sectional areas at several places on a cone is a continual and gentle declining-curve accompanied by the increasing of radii, the cone may be deemed acceptable. If the "A" curve is in a gradually rising trend, the cone is practically unsuitable, as it is liable to gain unnecessary weight, even if it should satisfy the requirement for stiffness. This method of inspecting the performance of the dynamic speakers by the criterion, that is;

> "if the sectional areas $A_1$ and $A_2$ gained by the cutting of a cone with two concentric cylinders having respective radius $r_1$ and $r_2$ are in a relationship $A_1 > A_2$, so long as $r_1 < r_2$, the cone is OKed, and when the relation is reversed the cone can not pass the inspection", is characteristically useful in the practical production of good speakers. This is a preferable inspection method in the practical design and production process, too.

Another effective inspection method is described with the reference to FIG. 9(*a*) and FIG. 9(*b*). If a truncated conical plate member 3, shown in FIG. 9(*b*), cut off from the cone in FIG. 9(*a*) with a pair of cylindrical planes having respectively the given radius $r_1$ and $r_2$, upon being suspended at a pin point 5 of the inside generatrix 4, swings to the direction of the arrow, in FIG. 9(*b*), it proves the relation $A_1 > A_2$. The pin point 5 is a point normal to the axis from a point along the axis which is exactly intermediate the point where $r_1$ and $r_2$ intersect the axis.

Now the merit of this invention is testified somewhat by the experimental data, although it can be far more realized by audition. As can be seen in FIG. 8 the curve of frequency characteristics plotted about a speaker with the external diameter 115 mm has little irregularily regardless of the single speaker type construction thereof; the impedance curve, shown in a phantom line, is also almost free of zigzag, proving the unchangeability of the trend irrespective of changes in frequencies. And a fact that a speaker with the external diameter of about 12 cm can produce an output comparable with that having the external diameter of 30 cm has been recognized. In this embodiment actual weight of the cone is about 9.5g. Warp of the cone may be only a very slight curvature, and it may be either outward or inward. A cone having no wrap is also usable in the present invention.

Before describing two of other embodiments, only by way of example, characteristics or features as well as practical effects of the first embodiment will be summed up as follows.

Features:

(a) a structure of high strength and stiffness has been employed;

(b) a number of ribs extending in the radial direction are provided;

(c) wall thickness is the greatest at the central portion (vibration causing portion) and progressively diminishing toward the peripheral portion; and (d) injection molding method of thermoplastic resin including glass fiber is employed for the purpose of enhancing strength and stiffness of the cone.

Effects:

(a) there is little flexion between the vibration causing, central-opening portion and the peripheralportion, and the entire cone vibrates almost as a single unit;

(b) the cone is constructed relatively light in weight for its strength and stiffness;

(c) speakers of extremely high in sound effects, that is highly efficient in sound reproductivity, have been thereby obtained (speakers featured in frequency characteristics and impedance characteristics);

(d) a great number of speakers perfectly uniform and of identical characteristic curve can be produced;

(e) a single type speaker is capable of really reproducing any sound over a wide range from high to low sound area; and (f) speakers with smaller diameter can be used for the purpose of producing as great output as those conventionally having several times as large diameter.

A second embodiment is a laminated cone formed of cured thermosetting resin of polyester group which have been impregnated in glass fiber. Ribs of modified form are arranged on a plate member of uniform thickness; that is, ribs of constant height but of tapered width, at the central portion being the greatest and gradually reduced toward the peripheral portion, have been experimented with great success. The abovementioned effects from (a) to (f) have all been testified good, except only one item (d), in this embodiment just like in the first embodiment.

As a third embodiment metal die forging of aluminum or aluminum alloys can be thought to be practicable. In this case ribs are provided and the stiffness may be greatest at the central portion and gradually diminishing toward the peripheral portion. Die casting method is thinkable for the manufacture of this embodiment; but making the peripheral portion extremely thin in die casting, which is required for cones of the type, is considerably difficult, if not impossible, at the present stage of art.

Effects described above in greater detail for the first embodiment are all good for all embodiments and can be said to be the very effects of this invention, which shall be summed up again in other words: (1) speakers of extermely high sound fidelity effects can be obtained; (2) the speakers are outstanding in frequency characteristics and impedance characteristics; (3) a single type speaker of this invention has the ability of really reproducing all sounds ranging over a wide sound area; and (4) the speaker with a smaller diameter can produce a large output for the size thereof.

It will be obvious to those skilled in the art that various changes may be made without departing from the scope of the invention and the invention is not to be considered limited to what is shown in the drawings and described in the specification.

What is claimed is:

1. A convex cone of truncated conical form for use in a dynamic speaker having a number of integrally formed radial ribs thereon, extending from the throat portion toward the peripheral portion thereof, said cone being characterized by the relationship $A_1 > A_2$ so long as $r_{1<r2}$, where $A_1$ and $A_2$ are the cross sectional areas of said cone when said cone is cut parallel to the axis of said cone at radii $r_1$ and $r_2$ respectively.

2. A dynamic speaker claimed in claim 1 made of injection molded thermoplastic resin reinforced with glass fiber.

3. A method of inspecting the manufacture of a substantially convex truncated conical form for a dynamic speaker, which method comprises the following comparison as an inspection process:

(a) cutting said cone parallel to the axis of said cone in 2 places, distances $r_1$ and $r_2$ from the axis of said cone, $r_1$ being less than $r_2$;

(b) rejecting the manufactured cone if the cross sectional areas $A_1$, produced by cutting said cone in step (a) at $r_1$, is less than or equal to $A_2$, the cross sectional area produced by cutting said cone is step (a) at $r_2$;

(c) accepting the manufactured cone if the cross sectional area $A_1$ is greater than $A_2$.

* * * * *